US008633274B2

(12) United States Patent
Bonn et al.

(10) Patent No.: US 8,633,274 B2
(45) Date of Patent: Jan. 21, 2014

(54) AQUEOUS DISPERSIONS OF REACTIVE GLUING AGENTS, METHOD FOR THE PRODUCTION AND THE USE THEREOF

(75) Inventors: Johann Bonn, Hessheim (DE); Roland Ettl, Ketsch (DE); Klaus Lorenz, Worms (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1563 days.

(21) Appl. No.: 10/589,857

(22) PCT Filed: Feb. 26, 2005

(86) PCT No.: PCT/EP2005/002051

§ 371 (c)(1),
(2), (4) Date: Aug. 17, 2006

(87) PCT Pub. No.: WO2005/083174

PCT Pub. Date: Sep. 9, 2005

(65) Prior Publication Data

US 2007/0167558 A1 Jul. 19, 2007

(30) Foreign Application Priority Data

Mar. 1, 2004 (DE) ..... 10 2004 010 447

(51) Int. Cl.
*C08F 8/30* (2006.01)

(52) U.S. Cl.
USPC ..... 524/555

(58) Field of Classification Search
None
See application file for complete search history.

(56) References Cited

U.S. PATENT DOCUMENTS

| | | | | | |
|---|---|---|---|---|---|
| 2,627,477 | A | * | 2/1953 | Downey | 106/196.1 |
| 2,961,366 | A | * | 11/1960 | Weisgerber | 162/158 |
| 3,006,806 | A | * | 10/1961 | Schur | 162/158 |
| 3,223,544 | A | | 12/1965 | Savina | |
| 4,774,285 | A | * | 9/1988 | Pfohl et al. | 525/60 |
| 5,154,763 | A | * | 10/1992 | Ksoll et al. | 106/287.2 |
| 5,470,903 | A | * | 11/1995 | Lenney et al. | 524/458 |
| 5,498,648 | A | * | 3/1996 | de Clercq et al. | 524/47 |
| 5,942,588 | A | | 8/1999 | Ettl et al. | |
| 6,001,166 | A | * | 12/1999 | Ettl et al. | 106/287.2 |
| 2006/0162883 | A1 | | 7/2006 | Champ et al. | |

FOREIGN PATENT DOCUMENTS

| | | |
|---|---|---|
| DE | 33 16 179 A1 | 11/1984 |
| DE | 102 37 911 | 2/2004 |
| DE | 102 37 912 | 2/2004 |
| DE | 102 37 912 A1 | 2/2004 |
| EP | 0 353 212 A1 | 1/1990 |
| WO | 96/26318 | 8/1996 |
| WO | WO 98/41565 | 9/1998 |

* cited by examiner

*Primary Examiner* — Melvin C Mayes
*Assistant Examiner* — Stefanie Cohen
(74) *Attorney, Agent, or Firm* — Oblon, Spivak, McClelland, Maier & Neustadt, L.L.P.

(57) ABSTRACT

Aqueous dispersions of reactive sizes comprise cationic polymers comprising vinylamine units as a protective colloid, the protective colloid comprising less than 0.0001% by weight, based on the protective colloid, of diketenes.

26 Claims, No Drawings

AQUEOUS DISPERSIONS OF REACTIVE GLUING AGENTS, METHOD FOR THE PRODUCTION AND THE USE THEREOF

DESCRIPTION

The present invention relates to aqueous dispersions of reactive sizes which comprise cationic polymers comprising vinylamine units as a protective colloid, the protective colloid comprising less than 0.0001% by weight, based on the protective colloid, of diketene. The present invention furthermore relates to a process for the preparation of the aqueous dispersions, their use for the sizing of paper, board and cardboard, and a process for the sizing of paper, board and cardboard.

Aqueous alkyldiketene dispersions which are stabilized with cationic starch or with anionic emulsifiers are commercially available engine sizes for paper. The full sizing effect of the papers sized with alkyldiketene dispersions develops only on storage of the sized papers. Such papers therefore cannot be further processed immediately after the papermaking, for example, enhanced with coating slips, or printed on. Rather, they must be stored for at least 24 hours until a sufficient sizing effect develops. However, it is known from the literature that cationic polymers increase the rate of development of the sizing.

Although the conventional size dispersions comprising cationic polymers increase the rate of development of the sizing, they are frequently not storage-stable over a relatively long time.

DE-A-3 316 179 describes AKD dispersions which comprise polymers comprising ethylenimine units and a water-soluble dicyandiamide/formaldehyde condensate. Although the latter increases the rate of development of the sizing (i.e. promoter effect), it does not contribute towards stabilizing the dispersion.

U.S. Pat. No. 3,223,544 as well as EP-A-0 353 212 discloses alkyldiketene (AKD) dispersions with cationic starch as a protective colloid and an anionic dispersant as a stabilizer.

WO-A-96/26318 discloses AKD dispersions which comprise, as protective colloids, either copolymers of N-vinylpyrrolidone and N-vinylimidazole or condensates based on polyethylenimines. The preparation of these AKD dispersions is very complicated owing to the copolymerization or condensation of the protective colloids.

The use of polymers comprising vinylamine units as promoters for the engine sizing in starch-containing AKD dispersions is disclosed in prior German Patent Application 10 237 911.4.

Prior German Patent Application 10 237 912.2 discloses a process for the engine sizing of paper, in which a reactive size, a retention aid and a cationic polymer which is selected from polymers comprising vinylamine units, polymers comprising vinylguanadine units, polyethylenimines, polyamidoamines grafted with ethylenimine and polydiallyldimethylammonium chlorides are added to the aqueous slurry of cellulose fibers. The cationic polymers are added separately from the reactive sizes, or the components are metered together, but without a dispersion being prepared beforehand from the components.

WO-A-98/41565 discloses AKD dispersions which comprise, as a protective colloid, reaction products of amino-comprising polymers from the group consisting of the polymers comprising vinylamine units, polyamidoamines and polyamidoamines grafted with polyethylenimine with diketenes in the weight ratio of polymer to diketene of from 10 000:1 to 1:3. However, the preparation of the protective colloid is very complicated.

It is an object of the present invention to provide aqueous dispersions of reactive sizes, which dispersions are improved compared with the prior art, are simple to prepare and have both a higher rate of development of the sizing and sufficient storage stability.

We have found that this object is achieved, according to the invention, by aqueous dispersions of reactive sizes which comprise cationic polymers comprising vinylamine units as a protective colloid, the protective colloid comprising less than 0.0001% by weight, based on the protective colloid, of diketenes. In this context, diketenes are understood as meaning the $C_{12}$-$C_{22}$-alkylketene dimers described in more detail below.

Aqueous dispersions whose protective colloids are substantially free of diketenes are preferred, and those whose protective colloids are completely free of diketenes are particularly preferred.

Furthermore, aqueous dispersions which generally comprise less than 0.0001% by weight of reactive size are preferred. Reactive sizes are understood as meaning, in addition to the $C_{12}$- to $C_{22}$-alkylketene dimers, also the $C_5$- to $C_{22}$-alkyl- or $C_5$- to $C_{22}$-alkenylsuccinic anhydrides, $C_{12}$- to $C_{36}$-alkyl isocyanates, organic isocyanates and/or mixtures thereof, which are described in more detail below.

Aqueous dispersions whose protective colloids are substantially free of reactive sizes are preferred, and those whose protective colloids are completely free of reactive sizes are particularly preferred.

Furthermore, those aqueous dispersions which comprise less than 1% by weight, based on the aqueous dispersion, of cationic starch are preferred.

Those aqueous dispersions which are substantially free of cationic starch are particularly preferred, and those which are completely free of cationic starch are especially preferred.

According to the invention, at least one polymer comprising vinylamine units is used as a protective colloid for the reactive size in the novel aqueous dispersions. The amount of cationic polymer is, for example, from 10 to 100, preferably from 15 to 75, particularly preferably from 20 to 50, % by weight, based on the reactive size.

Polymers comprising vinylamine units are known, cf. U.S. Pat. Nos. 4,421,602, 5,334,287, EP-A-0 216 387, U.S. Pat. No. 5,981,689, WO-A-00/63295 and U.S. Pat. No. 6,121,409. They are prepared by hydrolysis of open-chain polymers comprising N-vinylcarboxamide units. These polymers are obtainable, for example, by polymerization of N-vinylformamide, N-vinyl-N-methylformamide, N-vinylacetamide, N-vinyl-N-methylacetamide, N-vinyl-N-ethylacetamide and N-vinylpropionamide. Said monomers can be polymerized either alone or together with other monomers.

Suitable monoethylenically unsaturated monomers which are copolymerized with the N-vinylcarboxamides are all compounds copolymerizable therewith. Examples of these are vinyl esters of saturated carboxylic acids of 1 to 6 carbon atoms, such as vinyl formate, vinyl acetate, vinyl propionate and vinyl butyrate, and vinyl ethers, such as $C_1$- to $C_6$-alkyl vinyl ether, e.g. methyl or ethyl vinyl ether. Further suitable comonomers are esters, amides and nitriles of ethylenically unsaturated $C_3$- to $C_6$-carboxylic acids, for example methyl acrylate, methyl methacrylate, ethyl acrylate and ethyl methacrylate, acrylamide and methacrylamide and acrylonitrile and methacrylonitrile.

Further suitable carboxylic esters are derived from glycols or polyalkylene glycols, in each case only one OH group being esterified, e.g. hydroxyethyl acrylate, hydroxyethyl methacrylate, hydroxypropyl acrylate, hydroxybutyl acrylate, hydroxypropyl methacrylate, hydroxybutyl methacrylate and acrylic monoesters of polyalkylene glycols having a molar mass of from 500 to 10 000. Further suitable comonomers are esters of ethylenically unsaturated carboxylic acids with amino alcohols, for example dimethylaminoethyl acrylate, dimethylaminoethyl methacrylate, diethylaminoethyl acrylate, diethylaminoethyl methacrylate, dimethylaminopropyl acrylate, dimethylaminopropyl methacrylate, diethylaminopropyl acrylate, dimethylaminobutyl acrylate and diethylaminobutyl acrylate. The basic acrylates can be used in the form of the free bases, of the salts with mineral acids, such as hydrochloric acid, sulfuric acid or nitric acid, or of the salts with organic acids, such as formic acid, acetic acid or propionic acid, or of the sulfonic acids or in quaternized form. Suitable quaternizing agents are, for example, dimethyl sulfate, diethyl sulfate, methyl chloride, ethyl chloride or benzyl chloride.

Further suitable comonomers are amides of ethylenically unsaturated carboxylic acids, such as acrylamide, methacrylamide and N-alkylmono- and diamides of monoethylenically unsaturated carboxylic acids having alkyl radicals of 1 to 6 carbon atoms, e.g. N-methylacrylamide, N,N-dimethylacrylamide, N-methylmethacrylamide, N-ethylacrylamide, N-propylacrylamide and tert-butylacrylamide, and basic (meth)acrylamides, e.g. dimethylaminoethylacrylamide, dimethylaminoethyl-methacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Furthermore, N-vinylpyrrolidone, N-vinylcaprolactam, acrylonitrile, methacrylonitrile, N-vinylimidazole and substituted N-vinylimidazoles, e.g. N-vinyl-2-methylimidazole, N-vinyl-4-methylimidazole, N-vinyl-5-methylimidazole or N-vinyl-2-ethylimidazole, and N-vinylimidazolines, such as N-vinylimidazoline, N-vinyl-2-methylimidazoline and N-vinyl-2-ethylimidazoline, are suitable as comonomers. N-Vinylimidazoles and N-vinylimidazolines are used not only in the form of the free bases but also in the form neutralized with mineral acids or organic acids or in quaternized form, the quaternization preferably being carried out with dimethyl sulfate, diethyl sulfate, methyl chloride or benzyl chloride. Diallyldialkylammonium halides, e.g. diallyldimethylammonium chloride, are also suitable.

The copolymers comprise, for example, from 95 to 5, preferably from 90 to 10, mol % of at least one N-vinylcarboxamide and from 5 to 95, preferably from 10 to 90, mol % of other monoethylenically unsaturated monomers copolymerizable therewith incorporated in the form of polymerized units. The comonomers are preferably free of acid groups.

In order to prepare polymers comprising vinylamine units, it is preferable to start from homopolymers of N-vinylformamide or from copolymers which are obtainable by copolymerization of N-vinylformamide with vinyl formate, vinyl acetate, vinyl propionate, acrylonitrile, N-vinylcaprolactam, N-vinylurea, N-vinylpyrrolidone or $C_1$- to $C_6$-alkyl vinyl ethers and subsequent hydrolysis of the homopolymers or of the copolymers with formation of vinylamine units from the N-vinylformamide units incorporated in the polymer, the degree of hydrolysis being, for example, from 1 to 100, preferably from 25 to 100, particularly preferably from 50 to 100, in particular from 70 to 100, mol %. The hydrolysis of the polymers described above is effected by known methods, by the action of acids, bases or enzymes. When acids are used as hydrolysis agents, the vinylamine units of the polymers are present in the form of an ammonium salt, whereas the free amino groups form in the case of the hydrolysis with bases. The polymers comprising vinylamine units can be used in the form of the free bases, of the ammonium salts or in quaternized form as a promoter.

In most cases, the degree of hydrolysis of the homo- and copolymers used is from 90 to 95 mol %. The degree of hydrolysis of the homopolymers is equivalent to the content of vinylamine units in the polymers. In the case of copolymers which comprise vinyl esters incorporated in the form of polymerized units, hydrolysis of the ester groups with formation of vinyl alcohol units may occur in addition to the hydrolysis of the N-vinylformamide units. This is the case in particular when the hydrolysis of the copolymers is carried out in the presence of sodium hydroxide solution. Acrylonitrile incorporated in the form of polymerized units is likewise chemically changed in the hydrolysis. Here, for example, amide groups or carboxyl groups form. The homo- and copolymers comprising vinylamine units can, if appropriate, comprise up to 20 mol % of amidine units, which form, for example, by reaction of formic acid with two adjacent amino groups or by intramolecular reaction of an amino group with an adjacent amide group, for example of N-vinylformamide incorporated in the form of polymerized units. The average molar masses Mw of the polymers comprising vinylamine units are, for example, from 500 to 10 million, preferably from 750 to 5 million, particularly preferably from 1000 to 2 million (determined by light scattering). This molar mass range corresponds, for example, to K values of from 30 to 150, preferably from 60 to 90 (determined according to H. Fikentscher in 5% strength aqueous sodium chloride solution at 25° C., a pH of 7 and a polymer concentration of 0.5% by weight). Cationic polymers which have K values of from 85 to 90 are particularly preferably used.

The polymers comprising vinylamine units are preferably used in salt-free form. Salt-free aqueous solutions of polymers comprising vinylamine units can be prepared, for example, from the salt-containing polymer solutions described above with the aid of ultrafiltration over suitable membranes with cut-offs of, for example, from 1 000 to 500 000, preferably from 10 000 to 300 000, daltons.

Derivatives of polymers comprising vinylamine units can also be used as cationic polymers. For example, it is possible to prepare a large number of suitable derivatives from the polymers comprising vinylamine units by amidation, alkylation, sulfonamide formation, urea formation, thiourea formation, carbamate formation, acylation, carboxymethylation, phosphonomethylation or Michael addition of the amino groups of the polymer. Of particular interest here are the uncrosslinked polyvinylguanidines, which are obtainable by reaction of polymers containing vinylamine units, preferably polyvinylamines, with cyanamide ($R^1R^2N$—CN, where $R^1$ and $R^2$ are H, $C_1$- to $C_4$-alkyl, $C_3$- to $C_6$-cycloalkyl, phenyl, benzyl, alkyl-substituted phenyl or naphthyl), cf. U.S. Pat. No. 6,087,448, column 3, line 64 to column 5, line 14.

The polymers comprising vinylamine units also contain hydrolyzed graft polymers of, for example, N-vinylformamide on polyalkylene glycols, polyvinyl acetate, polyvinyl alcohol, polyvinylformamides, polysaccharides, such as starch, oligosaccharides or monosaccharides. The graft polymers are obtainable by subjecting, for example, N-vinylformamide to free radical polymerization in an aqueous medium in the presence of at least one of said grafting bases, if appropriate together with other monomers which are copolymerizable, and then hydrolyzing the grafted-on vinylformamide units in a known manner to give vinylamine units.

Preferred polymers comprising vinylamine units are vinylamine homopolymers having a degree of hydrolysis of from 1 to 100, preferably from 25 to 100, mol % and copolymers of vinylformamide and vinyl acetate, vinyl alcohol, vinylpyrrolidone or acrylamide which have been hydrolyzed to a degree of from 1 to 100, preferably from 25 to 100, mol % and each of which have K values of from 30 to 150, in particular from 60 to 90.

The polymers comprising vinylamine units are used in the novel aqueous dispersions as protective colloids for reactive sizes in order to obtain aqueous size dispersions which have both a higher rate of development of the sizing and sufficient storage stability.

Suitable reactive sizes for the novel dispersions are, for example, $C_{12}$- to $C_{22}$-alkylketene dimers, $C_5$- to $C_{22}$-alkyl- or $C_5$- to $C_{22}$-alkenylsuccinic anhydrides, $C_{12}$- to $C_{36}$-alkyl isocyanates and/or organic isocyanates, such as dodecyl isocyanate, octadecyl isocyanate, tetradecyl isocyanate, hexadecyl isocyanate, eicosyl isocyanate and decyl isocyanate. Preferably used engine sizes are alkylketene dimers and long-chain alkyl- or alkenylsuccinic anhydrides.

Examples of alkylketene dimers are tetradecyldiketene, stearyldiketene, lauryldiketene, palmityldiketene, oleyldiketene, behenyldiketene or mixtures thereof. Alkyldiketenes having different alkyl groups, such as stearylpalmityldiketene, behenylstearyldiketene, behenyloleyldiketene or palmitylbehenyldiketene, are also suitable. Stearyldiketene, palmityldiketene, behenyldiketene or mixtures of behenyldiketene and stearyldiketene are preferably used. Substituted succinic anhydrides suitable as reactive sizes are, for example, decenylsuccinic anhydride, n-octadecenylsuccinic anhydride, dodecenylsuccinic anhydride and n-hexadecenylsuccinic anhydride.

Usually, the novel aqueous dispersions contain from 1 to 50% by weight, based on the total weight of the dispersion, of reactive sizes. For example, the dispersions have a content of from 1 to 50, preferably from 5 to 35, % by weight, based on the total weight of the dispersion, of $C_{12}$- to $C_{22}$-alkyldiketenes. With the use of $C_5$- to $C_{22}$-alkyl- or $C_5$- to $C_{22}$-alkenylsuccinic anhydrides, the content thereof is, for example, from 1 to 25, preferably from 2 to 10, % by weight, based on the total weight of the dispersion.

The alkyldiketenes and long-chain alkenyl- or alkylsuccinic anhydrides which are preferred as sizes and processes for the preparation of anionic aqueous dispersions of such reactive sizes are disclosed in WO-A-00/23651, cf. pages 2 to 12. For the preparation of size dispersions, the reactive sizes are usually heated to a temperature above their melting point and are emulsified in molten form in water under the action of shear forces. The liquid alkenylsuccinic anhydride can be emulsified at as low as room temperature. For example, homogenizers are used for this purpose. The dispersed sizes are stabilized in the aqueous phase using at least one anionic dispersant from the group consisting of the condensates of (a) naphthalenesulfonic acid and formaldehyde,
(b) phenol, phenolsulfonic acid and formaldehyde,
(c) naphthalenesulfonic acid, formaldehyde and urea and
(d) phenol, phenolsulfonic acid, formaldehyde and urea.

The anionic dispersants may be present in the form of the free acids, of the alkali metal salts or alkaline earth metal salts and/or of the ammonium salts. The ammonium salts may be derived both from ammonia and from primary, secondary and tertiary amines, for example the ammonium salts of dimethylamine, trimethylamine, hexylamine, cyclohexylamine, dicyclohexylamine, ethanolamine, diethanolamine and triethanolamine being suitable. The condensates described above are known and are commercially available. They are prepared by condensing said components, it also being possible to use the corresponding alkali metal, alkaline earth metal or ammonium salts instead of the free acids. Suitable catalysts in the condensation are, for example, acids, such as sulfuric acid, p-toluenesulfonic acid and phosphoric acid. Naphthalenesulfonic acid or an alkali metal salt thereof is condensed with formaldehyde preferably in the molar ratio of from 1:0.1 to 1:2, in general from 1:0.5 to 1:1. The molar ratio for the preparation of condensates of phenol, phenolsulfonic acid and formaldehyde is likewise in the abovementioned range, any desired mixtures of phenol and phenolsulfonic acid being used instead of naphthalenesulfonic acid in the condensation with formaldehyde. Instead of phenolsulfonic acid, it is also possible to use the alkali metal and ammonium salts of phenolsulfonic acid. The condensation of the abovementioned starting materials can, if appropriate, additionally be carried out in the presence of urea. For example, from 0.1 to 5 mol of urea are used per mole of naphthalenesulfonic acid or per mole of the mixture of phenol and phenolsulfonic acid, based on naphthalenesulfonic acid or on the mixture of phenol and phenolsulfonic acid.

The condensates have, for example, molar masses of from 800 to 100 000, preferably from 1 000 to 30 000, in particular from 4 000 to 25 000. Preferably used anionic dispersants are salts which are obtained, for example, by neutralizing the condensates with lithium hydroxide, sodium hydroxide, potassium hydroxide or ammonia. The pH of the salts is, for example, from 7 to 10.

Furthermore, ligninsulfonic acid and the alkali metal, alkaline earth metal and ammonium salts thereof are suitable as anionic dispersants.

Other suitable anionic dispersants are amphiphilic copolymers of (i) hydrophobic monoethylenically unsaturated monomers and
(ii) hydrophilic monomers having an anionic group, such as monoethylenically unsaturated carboxylic acids, monoethylenically unsaturated sulfonic acids, monoethylenically unsaturated phosphonic acids and mixtures thereof.

Suitable hydrophobic monoethylenically unsaturated monomers (a) are, for example, olefins of 2 to 150 carbon atoms, styrene, α-methylstyrene, ethylstyrene, 4-methylstyrene, acrylonitrile, methacrylonitrile, esters of monoethylenically unsaturated $C_3$- to $C_5$-carboxylic acids and monohydric alcohols, amides of acrylic acid or methacrylic acid with $C_1$- to $C_{24}$-alkylamines, vinyl esters of saturated monocarboxylic acids of 2 to 24 carbon atoms, diesters of maleic acid or fumaric acid with monohydric $C_1$- to $C_{24}$-alcohols, vinyl ethers of alcohols of 3 to 24 carbon atoms or mixtures of said compounds.

The amphiphilic copolymers contain, as hydrophilic monomers (b), for example monoethylenically unsaturated $C_3$- to $C_{10}$-carboxylic acids or anhydrides thereof, 2-acrylamido-2-methylpropanesulfonic acid, vinylsulfonic acid, styrenesulfonic acid, vinylphosphonic acid, salts of said monomers and mixtures thereof as hydrophilic monomers having an anionic group, incorporated in the form of polymerized units.

Aqueous size dispersions which comprise, as an anionic dispersant, amphiphilic copolymers of (a) α-olefins of 4 to 12 carbon atoms, styrene or mixtures thereof as hydrophobic monomers and (b) maleic acid, acrylic acid, methacrylic acid, monoesters of maleic acid and alcohols of 1 to 25 carbon atoms or alkoxylation products of such alcohols, monoamides of maleic acid, salts of said monomers or mixtures of these compounds as hydrophilic monomers having an anionic group incorporated in the form of polymerized units and have a molar mass Mw of from 1 500 to 100 000 are particularly preferred.

Copolymers of maleic anhydride with $C_4$- to $C_{12}$-olefins, particularly preferably $C_8$-olefins, such as 1-octene and diisobutene, are preferred as anionic dispersants. Diisobutene is very particularly preferred. The molar ratio of maleic anhydride to olefin is, for example, from 0.9:1 to 3:1, preferably from 0.95:1 to 1.5:1. These copolymers are preferably used in hydrolyzed form as aqueous solutions or dispersions, the anhydride group being present in acyclic form and preferably some or all of the carboxyl groups being neutralized. The following bases are used for the neutralization: alkali metal bases, such as sodium hydroxide, potassium hydroxide, sodium carbonate or potassium carbonate, alkaline earth metal salts, such as calcium hydroxide, calcium carbonate or magnesium hydroxide, ammonia, primary, secondary or tertiary amines, such as triethylamine, triethanolamine, diethanolamine, ethanolamine, morpholine, etc.

If the amphiphilic copolymers are not sufficiently water-soluble in the form of the free acid, they are used in the form of water-soluble salts; for example, the corresponding alkali metal, alkaline earth metal and ammonium salts are used. The molar mass Mw of the amphiphilic copolymers is, for example, from 800 to 250 000, in general from 1 000 to 100 000, preferably from 3 000 to 20 000, in particular from 1 500 to 10 000. The acid numbers of the amphiphilic copolymers are, for example, from 50 to 500, preferably from 150 to 300, mg KOH/g of polymer.

The amphiphilic copolymers are used, for example, in amounts of from 0.05 to 20, preferably from 0.5 to 10, % by weight, based on the reactive size, as an anionic dispersant for the preparation of the size dispersions. The amphiphilic copolymers are preferably used in amounts of from 0.1 to 2, in particular from 0.6 to 1, % by weight, based on the size to be dispersed.

The content of anionic dispersants in the aqueous dispersion is, for example, from 0.01 to 5, preferably from 0.01 to 2.5, very particularly preferably from 0.01 to 1, % by weight.

The novel aqueous dispersions may comprise further components, for example non-cellulose-reactive hydrophobic substances, which contribute toward improving the stability and are described, for example, in EP-A437 764 and EP-A-658 228. Suitable non-cellulose-reactive substances are, for example, fatty acids, fatty amides and fatty esters and waxes. Examples of these, without making any claim to completeness, are behenyl stearate, stearyl myristate, isododecyl stearate, dioleyl carbonate, oleyl stearyl carbonate, oleyl-N,N-distearylurethane, paraffin, glyceryl dioleate, glyceryl trioleate and glyceryl tristearate.

Furthermore, finely divided, aqueous polymer dispersions which are a size for paper may additionally be present in the novel dispersions. Such polymer dispersions are disclosed, for example, in EP-B-0 051 144, EP-B-0 257 412, EP-B-0 276 770, EP-B-0 058 313 and EP-B-0 150 003. Such polymer dispersions which act as paper sizes are obtainable, for example, by polymerizing from 1 to 32 parts by weight of a mixture of (a) styrene, acrylonitrile and/or methacrylonitrile, (b) acrylates and/or methacrylates of $C_1$- to $C_{18}$-alcohols and/or vinyl esters of saturated $C_2$- to $C_4$-carboxylic acids and, if appropriate, (c) other monoethylenically unsaturated copolymerizable monomers in aqueous solution in the presence of 1 part by weight of a solution copolymer as described in WO-A-96/31650 and the literature cited therein.

Suitable monomers of the group (a) are styrene, acrylonitrile, methacrylonitrile or mixtures of styrene and acrylonitrile or of styrene and methacrylonitrile. Acrylates and/or methacrylates of $C_1$- to $C_{18}$-alcohols and/or vinyl esters of saturated $C_2$- to $C_4$-carboxylic acids are used as monomers of group (b). Butyl acrylate and butyl methacrylate, e.g. isobutyl acrylate, n-butyl acrylate and isobutyl methacrylate, are preferably used as monomers of group (b). Monomers of group (c) are, for example, butadiene, isoprene, monoethylenically unsaturated $C_3$- to $C_5$-carboxylic acids, acrylamidomethylpropanesulfonic acid, sodium vinylsulfonate, vinylimidazole, N-vinylformamide, acrylamide, methacrylamide, N-vinylimidazoline and cationic polymers such as dimethylaminopropylmethacrylamide or dimethylaminoethyl acrylate methochloride. From 1 to 32 parts by weight of a monomer mixture comprising the components (a) to (c) are used per part by weight of the copolymer. The monomers of components (a) and (b) may be copolymerized in any desired ratio, for example in the molar ratio of from 0.1:1 to 1:0.1.

The monomers of group (c) are, if required, used for modifying the properties of the copolymers.

Details of the preparation of these additional polymer dispersions are to be found in WO-A-96/31650 and the literature cited there.

If these polymer dispersions are used in the novel aqueous dispersions of reactive sizes, preferred polymer dispersions of this type are those which comprise cationic polymers, such as dimethylaminopropylmethacrylamide and/or dimethylaminoethyl acrylate, in combination with styrene, acrylonitrile, butadiene and/or acrylates.

When such polymer dispersions are used, the content thereof is as a rule from 25 to 300, preferably from 50 to 250, particularly preferably from 75 to 200, % by weight, based on the reactive size.

The present invention furthermore relates to a process for the preparation of the novel aqueous dispersions of reactive sizes.

For example, an aqueous solution of a polymer comprising vinylamine units, at least one anionic dispersant and optionally further components, such as non-cellulose-reactive hydrophobic substances and said polymer dispersions may be initially taken and the reactive size dispersed therein at, for example, from 20 to 100° C., preferably from 40 to 90° C. The size is preferably added in the form of a melt and dispersed with vigorous stirring or shearing. In another variant, the size is first converted into an emulsion with the anionic dispersant. Thereafter, an aqueous solution of a polymer comprising vinylamine units is added, and the emulsification step is repeated. The preparation of the dispersions is carried out in apparatuses known to a person skilled in the art, for example high-pressure homogenizers, colloid mills and ultrasonic dispersers. The resulting dispersion is cooled in each case. In this manner, it is possible to prepare, for example, aqueous size dispersions which comprise from 0.1 to 65, preferably from 1 to 50, particularly preferably from 5 to 35, % by weight of an alkyldiketene or from 0.1 to 65, preferably from 1 to 50, particularly preferably from 1 to 25, in particular from 2 to 10, % by weight of an alkenylsuccinic anhydride as a size in dispersed form.

Such highly concentrated size dispersions have a relatively low viscosity, for example of from 20 to 1 000 mPa·s (measured using a Brookfield viscometer at 20° C.). In the preparation of the aqueous dispersions, the pH is, for example, from 2 to 8, preferably from 3 to 4. As a rule, aqueous size dispersions having a mean particle size of the sizes of from 100 to 3 000 nm, preferably from 250 to 2 000 nm, are obtained. The mean particle sizes can, however, also be smaller than 100 nm, for example from 50 to 100 nm, or larger than 3 000 nm, for example up to 4 μm depending on the choice of the protective colloid and of the anionic dispersant.

The novel dispersions are used as engine sizes in the production of paper, board and cardboard. Paper, board and cardboard are usually produced by draining a slurry of cellulose fibers. Suitable cellulose fibers are all grades customary for this purpose, for example cellulose fibers obtained from mechanical pulp and all fibers obtained from annual plants. Mechanical pulp includes, for example, groundwood, thermomechanical pulp (TMP), chemothermomechanical pulp (CTMP), pressure groundwood, semi-chemical pulp, high-yield pulp and refiner mechanical pulp (RMP) and waste papers. Chemical pulps, which can be used in bleached or unbleached form, are also suitable. Examples of these are sulfate, sulfite and soda pulp. Unbleached pulps, which are also referred to as unbleached kraft pulp, are preferably used. Said fibers can be used alone or as a mixture.

The pH of the cellulose fiber slurry is, for example, from 4 to 8, preferably from 6 to 8. The paper stock can be drained batchwise or continuously on a paper machine.

After the draining of the paper stock and drying of the paper product, engine-sized paper products, such as paper, board or cardboard, having a basis weight of, for example, from 20 to 400, preferably from 40 to 220, g/m$^2$, are obtained.

The paper stock is preferably additionally drained in the presence of a retention aid. Apart from anionic retention aids or nonionic retention aids, such as polyacrylamides, cationic polymers are preferably used as retention aids and as drainage aids. A significant improvement in the runability of the paper machines is achieved as a result.

Cationic retention aids which may be used are all products commercially available for this purpose. These are, for example, cationic polyacrylamides, polydiallyldimethylammonium chlorides, high molecular weight polyvinylamines, high molecular weight polyvinylamines having K values of more than 150, polyethylenimines, polyamines having a molar mass of more than 50 000, modified polyamines which are grafted with ethylenimine and, if appropriate, crosslinked, polyetheramides, polyvinylimidazoles, polyvinylpyrrolidines, polyvinylimidazolines, polyvinyltetrahydropyrines, poly(dialkylaminoalkyl vinyl ethers), poly(dialkylaminoalkyl (meth)acrylates) in protonated or in quaternized form and polyamidoamines obtained from dicarboxylic acid, such as adipic acid, and polyalkylenepolyamines, such as diethylenetriamineamine, which are grafted with ethylenimine and crosslinked with polyethylene glycol dichlorohydrin ethers according to DE-B-24 34 816, or polyamidoamines which have been reacted with epichlorohydrin to give water-soluble condensates, and copolymers of acrylamide or methacrylamide and dialkylaminoethyl acrylates or methacrylates, for example copolymers of acrylamide and dimethylaminoethyl acrylate in the form of the salt with hydrochloric acid or in the form quaternized with methyl chloride. Further suitable retention aids are microparticle systems comprising cationic polymers, such as cationic starch, and finely divided silica, or comprising cationic polymers, such as cationic polyacrylamide, and bentonite.

The cationic polymers which are used as retention aids have, for example, Fikentscher K values of more than 150 (determined in 5% strength aqueous sodium chloride solution at a polymer concentration of 0.5% by weight, at a temperature of 25° C. and a pH of 7). They are preferably used in amounts of from 0.01 to 0.3% by weight, based on dry cellulose fibers.

If necessary, further assistants, such as those known to a person skilled in the art from the literature, can be added to the paper stock prior to sheet formation. These are, for example, fixing agents, strength agents and antifoams.

The present invention furthermore relates to the use of the novel aqueous dispersions described above as engine sizes for the production of paper, board and cardboard.

The examples which follow illustrate the invention without restricting it.

Percentages in the examples are by weight, unless evident otherwise from the context. The K values were determined according to H. Fikentscher, Cellulose-Chemie 13 (1932), 58-64 and 71-74, in 5% strength aqueous sodium chloride solution at a temperature of 25° C. and a pH of 7 at a polymer concentration of 0.5% by weight. The molar masses Mw of the polymers were measured by light scattering. The mean particle diameter of the dispersed particles of the polymer dispersions was determined both by Fraunhofer diffraction using a Coulter apparatus of the type LS 230 with a small volume module and by electron microscopy. The viscosities were determined using a Brookfield viscometer at a temperature of 22° C.

EXAMPLES

Ink Flotation Time

The ink flotation time (measured in minutes) is the time which a test ink requires according to DIN 53 126 for 50% strike-through through a test sheet.

Cobb Value

The determination was effected according to DIN 53 132 by storing the paper sheets for a period of 60 seconds in water. The water absorption is stated in g/m$^2$.

Edge Penetration

The paper sheet is covered on both sides with an adhesive tape without streaks. Strips measuring 25×75 mm are then cut therefrom. These test strips are immersed in a 30% strength hydrogen peroxide bath at 70° C. or in a 3% strength lactic acid bath at 25° C. The edge penetration is determined by differential weighing of the dry test strips and the test strips immersed in the bath.

Polyvinylamine 1

Cationic polymer which was obtained by hydrolysis of poly-N-vinylformamide having a K value of 90 with a degree of hydrolysis of 95 mol % (polymer which comprises 95 mol % of vinylamine units and 5 mol % of vinylformamide units).

Polyvinylamine 2

Cationic polymer which was obtained by hydrolysis of poly-N-vinylformamide having a K value of 75 with a degree of hydrolysis of 65 mol % (polymer which comprises 65 mol % of vinylamine units and 35 mol % of vinylformamide units).

Polyvinylamine 3

Cationic polymer which was obtained by hydrolysis of poly-N-vinylformamide having a K value of 110 with a degree of hydrolysis of 95 mol % (polymer which comprises 95 mol % of vinylamine units and 5 mol % of vinylformamide units).

Dispersion 1

76 g of an aqueous 8% strength by weight solution of the polyvinylamine 1, brought to a pH of 3.7, were heated to 75° C. 3 g of a 5% strength by weight sodium salt of the condensate of naphthalenesulfonic acid with formaldehyde in the molar ratio 1:0.8, having a molar mass Mw of 7 000, were stirred in as an anionic dispersant using a high-speed stirrer. 12 g of stearyldiketene were then added, likewise using a high-speed stirrer. The resulting emulsion was homogenized by means of a high-pressure homogenizer at 170 bar and 75° C. and then rapidly cooled with ice. The dispersion had a viscosity of 120 mPa·s and a mean particle size of 1.6 μm at 22° C.

Dispersion 2

89 g of an aqueous 3% strength by weight solution of the polyvinylamine 2, brought to a pH of 3.4, were heated to 75° C. 1.78 g of a 5% strength by weight ligninsulfonate sodium salt were stirred in as an anionic dispersant using a high-speed stirrer. 7 g of stearyldiketene were then added using a high-speed stirrer. The resulting emulsion was homogenized by means of a high-pressure homogenizer at 190 bar and 75° C. and then rapidly cooled with ice. The dispersion had a viscosity of 20 mPa·s and a mean particle size of 0.98 μm at 22° C.

Dispersion 3

68 g of an aqueous 8% strength by weight solution of the polyvinylamine 3, brought to a pH of 3.6, were heated to 75° C. 2 g of a 5% strength by weight ligninsulfonate sodium salt were stirred in as an anionic dispersant using a high-speed stirrer. 15 g of stearyldiketene were then added, likewise using a high-speed stirrer. The resulting emulsion was homogenized by means of a high-pressure homogenizer at 170 bar and 75° C. and then rapidly cooled with ice. The dispersion had a viscosity of 120 mPa·s and a mean particle size of 1.6 μm at 22° C.

Dispersion 4

20 g of the dispersion 1 were mixed by means of an intensive stirrer with 12 g of 30% strength by weight polymer dispersion prepared from the monomers styrene, butyl acrylate and a cationic acrylamide (Basoplast® 270D), having a mean particle size of 45 nm. The resulting dispersion had a viscosity of 700 mPa·s and a mean particle size of 1.7 μm at 22° C.

Comparative Dispersion 1

Example 1 from WO 6/26318

Comparative Dispersion 2

Size 2 from WO 98/41565

Use Examples

Example 1

The amounts of dispersions 1 to 4 and comparative dispersions 1 and 2 stated in table 1, 20% by weight of calcium carbonate, 0.6% by weight of a cationic cornstarch and 0.04% by weight of a cationic polyacrylamide (Polymin® KE2020) as a retention aid, based in each case on dry cellulose fiber mixture, were added to a paper stock having a consistency of 8 g/l and comprising a completely bleached mixture of 70% of pine sulfate pulp and 30% of birch sulfate pulp, having a freeness of 35° (Schopper-Riegler). The pH of the mixtures was brought to 7. The mixtures were then processed on a Rapid-Köthen sheet former to give a sheet having a basis weight of 80 g/m$^2$. The sheet was then dried on a steam-heated drying cylinder at 90° C. to a water content of 7%. Immediately after the drying, the Cobb value of the sheets was determined: The sheets were then stored for 24 hours at 25° C. and a relative humidity of 50%. The measurements were then repeated. The results obtained are shown in table 1.

TABLE 1

| Test No. | Dispersion | [% by weight] stearyl-diketene, based on dry paper stock | Cobb 60 in g/m$^2$ immediately | Cobb 60 in g/m$^2$ after 24 h | Ink flotation time after 24 h in min |
|---|---|---|---|---|---|
| 1 | Comp. dispersion 1 | 0.9 | 48 | 25 | 45 |
| 2 | Comp. dispersion 2 | 0.9 | 45 | 25 | 46 |
| 3 | Dispersion 1 | 0.9 | 32 | 24 | 50 |
| 4 | Dispersion 2 | 0.9 | 34 | 23 | 55 |
| 5 | Dispersion 3 | 0.9 | 37 | 24 | 55 |
| 6 | Dispersion 4 | 0.9 | 30 | 22 | 60 |

Test No. 1 and 2 are comparative examples and tests 3 to 6 are examples according to the invention.

Example 2

The amounts of dispersions 1 to 4 and comparative dispersions 1 and 2 reported in table 2, 0.6% by weight of a cationic cornstarch and 0.04% by weight of a cationic polyacrylamide (Polymin® KE2020) as a retention aid, based in each case on dry cellulose fiber mixture, were added to a paper stock having a consistency of 8 g/l and comprising 100% of waste paper. The pH of the mixtures was brought to 7. The mixtures were then processed on a Rapid-Köthen sheet former to give a sheet having a basis weight of 100 g/m$^2$. The sheet was then dried on a steam-heated drying cylinder at 90° C. to a water content of 7%. The sheets were then stored for 24 hours at 25° C. and a relative humidity of 50%. The measurements were then repeated. The results obtained are shown in table 2.

TABLE 2

| Test No. | Dispersion | [% by weight] stearyldiketene, based on dry paper stock | Cobb 60 in g/m$^2$ after 24 h | Ink flotation time after 24 h in min |
|---|---|---|---|---|
| 7 | Comp. dispersion 1 | 1.3 | 42 | 33 |
| 8 | Comp. dispersion 2 | 1.3 | 39 | 37 |
| 9 | Dispersion 1 | 1.3 | 29 | 55 |
| 10 | Dispersion 2 | 1.3 | 30 | 52 |
| 11 | Dispersion 3 | 1.3 | 26 | 60 |
| 12 | Dispersion 4 | 1.3 | 30 | 53 |

Test No. 7 and 8 are comparative examples and tests 9 to 12 are examples according to the invention.

Example 3

The amounts of dispersions 1 to 4 and comparative dispersions 1 and 2 stated in table 3, 20% by weight of calcium carbonate, 0.75% by weight of a cationic cornstarch and 0.04% by weight of a cationic polyacrylamide (Polymin® KE2020) as a retention aid, based in each case on dry cellulose fiber mixture, were added to a paper stock having a consistency of 8 g/l and comprising a completely bleached mixture of 70% of pine sulfate pulp and 30% of birch sulfate pulp, having a freeness of 35° (Schopper-Riegler). The pH of the mixtures was brought to 7. The mixtures were then processed on a Rapid-Köthen sheet former to give a sheet having a basis weight of 150 g/m$^2$. The sheet was then dried on a steam-heated drying cylinder at 90° C. to a water content of 7%. The sheets were then covered on both sides with an adhesive tape without streaks. Strips measuring 25×75 mm were cut from the sheets. The test strips were immersed in a 30% strength hydrogen peroxide bath at 70° C. or in a 3% strength lactic acid bath at 25° C. The edge penetration was determined by differential weighing. The results obtained are shown in table 3.

TABLE 3

| Test No. | Dispersion | [% by weight] stearyldiketene, based on dry paper stock | Edge penetration peroxide in $kg/m^2$ | Edge penetration lactic acid in $kg/m^2$ |
|---|---|---|---|---|
| 13 | Comp. dispersion 1 | 2.0 | 2.45 | 0.76 |
| 14 | Comp. dispersion 2 | 2.0 | 1.98 | 0.76 |
| 15 | Dispersion 1 | 2.0 | 1.23 | 0.54 |
| 16 | Dispersion 2 | 2.0 | 1.42 | 0.44 |
| 17 | Dispersion 3 | 2.0 | 1.34 | 0.51 |
| 18 | Dispersion 4 | 2.0 | 1.51 | 0.49 |

Test No. 13 and 14 are comparative examples and tests 15 to 18 are examples according to the invention.

We claim:

1. An aqueous dispersion of a reactive size which comprises:

a reactive phase comprising one or more diketenes and an anionic dispersant; and a protective colloid comprising a cationic polymer comprising vinylamine units;

wherein the protective colloid comprises less than 0.0001% by weight, based on the protective colloid, of the diketenes; and wherein the anionic dispersant is at least one selected from the group consisting of a condensate of a naphthalenesulfonic acid and formaldehyde; a condensate of a phenol, phenolsulfonic acid and formaldehyde; a condensate of a naphthalenesulfonic acid, formaldehyde and urea; a condensate of a phenol, phenolsulfonic acid, formaldehyde and urea; a ligninsulfonate; a cationic acrylate polymer; and a cationic acrylamide polymer, wherein the aqueous dispersion contains less than 0.1% by weight of cationic starch.

2. The aqueous dispersion according to claim 1, wherein the protective colloid is substantially free of diketenes.

3. The aqueous dispersion according to claim 1, wherein the cationic polymer comprising vinylamine units comprises from 1 to 100 mol % of hydrolyzed homo- or copolymers of N-vinylformamide.

4. The aqueous dispersion according to claim 1, wherein the cationic polymer comprising vinylamine units has an average molecular weight Mw of from 1000 to 2 million.

5. The aqueous dispersion according to claim 1, wherein the content of protective colloid is from 10 to 100% by weight, based on the reactive size.

6. The aqueous dispersion according to claim 1, wherein the diketenes comprise one or more selected from the group consisting of a C12- to C22 alkylketene dimer, a C5- to C22-alkyl-succinic anhydride, a C5- to C22-alkenylsuccinic anhydride and a C12- to C36-alkyl isocyanate.

7. The aqueous dispersion according to claim 6, wherein the diketenes are present in an amount of from 1 to 50% by weight, based on the total weight of the dispersion.

8. A process for the preparation of an aqueous dispersion according to claim 1, comprising homogenizing the diketenes and the cationic polymer comprising vinylamine units in an aqueous mixture in the presence of the anionic dispersant at from 20 to 100° C. under the action of shear forces.

9. A process for engine sizing paper, board and cardboard comprising adding an aqueous dispersion of claim 1 to an aqueous slurry of cellulose fibers and draining the paper stock.

10. The aqueous dispersion according to claim 1, wherein the cationic polymer is a hydrolyzed poly-N-vinylformamide polymer having a K value of 75-110 and a degree of hydrolysis of 65-95 mol % of vinylamine units.

11. The aqueous dispersion of claim 10, wherein the ketenes comprise stearyldiketene.

12. The aqueous dispersion of claim 11, having a pH of 3.4-3.7.

13. The aqueous dispersion according to claim 11, wherein the stearyldiketene is present in an amount of from 1 to 50% by weight.

14. The aqueous dispersion according to claim 1, wherein the anionic dispersant is at least one selected from the group consisting of a condensate of a naphthalenesulfonic acid and formaldehyde; a condensate of a phenol, phenolsulfonic acid and formaldehyde; a condensate of a naphthalenesulfonic acid, formaldehyde and urea; and a condensate of a phenol, phenolsulfonic acid, formaldehyde and urea.

15. The aqueous dispersion according to claim 1, which is completely free of a cationic starch.

16. A non-cellulose aqueous dispersion of a reactive size which comprises:

a reactive phase comprising one or more diketenes and an anionic dispersant; and a protective colloid comprising a cationic polymer comprising vinylamine units;

wherein the protective colloid comprises less than 0.0001% by weight, based on the protective colloid, of the diketenes, wherein the aqueous dispersion contains less than 0.1% by weight of cationic starch.

17. The non-cellulose aqueous dispersion of claim 16, wherein the anionic dispersant is at least one selected from the group consisting of a condensate of a naphthalenesulfonic acid and formaldehyde; a condensate of a phenol, phenolsulfonic acid and formaldehyde; a condensate of a naphthalenesulfonic acid, formaldehyde and urea; a condensate of a phenol, phenolsulfonic acid, formaldehyde and urea; a ligninsulfonate; a cationic acrylate polymer; and a cationic acrylamide polymer.

18. The aqueous dispersion according to claim 16, wherein the protective colloid is free of diketenes.

19. The aqueous dispersion according to claim 16, wherein the cationic polymer comprising vinylamine units comprises from 1 to 100 mol % of hydrolyzed homo- or copolymers of N-vinylformamide.

20. The aqueous dispersion according to claim 16, wherein the cationic polymer comprising vinylamine units has an average molecular weight Mw of from 1000 to 2 million.

21. The aqueous dispersion according to claim 16, wherein the content of protective colloid is from 10 to 100% by weight, based on the reactive size.

22. The aqueous dispersion according to claim 16, wherein the ketenes comprise one or more selected from the group consisting of a $C_{12}$- to $C_{22}$-alkylketene dimer, a $C_5$- to $C_{22}$-alkyl-succinic anhydride, a $C_5$- to $C_{22}$-alkenylsuccinic anhydride and a $C_{12}$- to $C_{36}$-alkyl isocyanate.

23. The aqueous dispersion according to claim 16, wherein the ketenes are present in an amount of from 1 to 50% by weight, based on the total weight of the dispersion.

24. The aqueous dispersion of claim 16, wherein the ketenes comprise stearyldiketene.

25. The non-cellulose aqueous dispersion of claim 16, wherein the anionic dispersant is at least one selected from the group consisting of a condensate of a naphthalenesulfonic acid and formaldehyde; a condensate of a phenol, phenolsulfonic acid and formaldehyde; a condensate of a naphthalenesulfonic acid, formaldehyde and urea; and a condensate of a phenol, phenolsulfonic acid, formaldehyde and urea.

26. The aqueous dispersion according to claim 16, which is completely free of a cationic starch.

* * * * *